US011136656B2

(12) United States Patent
Garza-Martinez et al.

(10) Patent No.: US 11,136,656 B2
(45) Date of Patent: Oct. 5, 2021

(54) HIGH MANGANESE 3rd GENERATION ADVANCED HIGH STRENGTH STEELS

(71) Applicant: AK Steel Properties, Inc., West Chester, OH (US)

(72) Inventors: Luis Gonzalo Garza-Martinez, Wyoming, OH (US); Grant Aaron Thomas, Liberty Township, OH (US); Amrinder Singh Gill, West Chester, OH (US)

(73) Assignee: Cleveland-Cliffs Steel Properties Inc., Cincinnati, OH (US)

( * ) Notice: Subject to any disclaimer, the term of this patent is extended or adjusted under 35 U.S.C. 154(b) by 0 days.

(21) Appl. No.: 15/160,573

(22) Filed: May 20, 2016

(65) Prior Publication Data

US 2016/0340763 A1 Nov. 24, 2016

Related U.S. Application Data

(60) Provisional application No. 62/164,643, filed on May 21, 2015.

(51) Int. Cl.

| | |
|---|---|
| ***C22C 38/58*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/04*** | (2006.01) |
| ***C22C 38/38*** | (2006.01) |
| ***C21D 6/00*** | (2006.01) |
| ***C22C 38/22*** | (2006.01) |
| ***C22C 38/02*** | (2006.01) |
| ***C21D 8/02*** | (2006.01) |
| ***C22C 38/18*** | (2006.01) |
| *C21D 9/46* | (2006.01) |

(52) U.S. Cl.

CPC ..... *C22C 38/58* (2013.01); *C21D 6/002* (2013.01); *C21D 6/005* (2013.01); *C21D 8/0226* (2013.01); *C21D 8/0236* (2013.01); *C21D 8/0247* (2013.01); *C22C 38/02* (2013.01); *C22C 38/04* (2013.01); *C22C 38/06* (2013.01); *C22C 38/18* (2013.01); *C22C 38/22* (2013.01); *C22C 38/34* (2013.01); *C22C 38/38* (2013.01); *C22C 38/42* (2013.01); *C22C 38/44* (2013.01); *C21D 9/46* (2013.01); *C21D 2211/001* (2013.01)

(58) Field of Classification Search

CPC ..... C22C 38/58; C21D 2211/001

See application file for complete search history.

(56) References Cited

U.S. PATENT DOCUMENTS

| | | | | |
|---|---|---|---|---|
| 2011/0083774 | A1 | 4/2011 | Hoon et al. | |
| 2012/0160363 | A1 | 6/2012 | Jin et al. | |
| 2014/0050941 | A1* | 2/2014 | Kawasaki | C21D 9/46 428/653 |
| 2016/0145725 | A1* | 5/2016 | Branagan | C21D 8/0205 148/541 |
| 2018/0023171 | A1* | 1/2018 | Oh | C21D 8/0463 420/73 |

FOREIGN PATENT DOCUMENTS

| | | | | |
|---|---|---|---|---|
| CN | 102471821 | | 5/2012 | |
| CN | 103502496 | A | 1/2014 | |
| CN | 103820735 | A | 5/2014 | |
| EP | 0023398 | A1 | 2/1981 | |
| EP | 1707645 | A1 | 10/2006 | |
| EP | 2090668 | A1 * | 8/2009 | C22C 38/58 |
| EP | 2327810 | A1 | 6/2011 | |
| EP | 2228459 | B1 | 10/2011 | |
| EP | 2703512 | A1 | 3/2014 | |
| EP | 2738278 | A1 | 6/2014 | |
| EP | 2683839 | B1 | 4/2015 | |
| JP | S49-034566 | | 3/1974 | |
| JP | S 57-185958 | | 11/1982 | |
| JP | H 06-136578 | | 5/1994 | |
| JP | H06128631 | A | 5/1994 | |
| JP | H0762485 | A | 3/1995 | |
| JP | 2005200694 | A | 7/2005 | |
| JP | 2005-213628 | A | 8/2005 | |
| JP | 2009-532584 | | 9/2009 | |
| JP | 2010-185109 | | 8/2010 | |
| JP | 2013-185242 | | 9/2013 | |
| JP | 2015-503023 | | 1/2015 | |

(Continued)

OTHER PUBLICATIONS

International Search Report and Written Opinion for PCT Publication No. WO 2016/187577 A1.
Office Action for Taiwan Patent Application No. TW 105115892, dated Mar. 3, 2017.
Australian Office Action dated Jun. 22, 2018 for Application No. 2016264750, 3 pgs.
Chinese Office Action dated Nov. 1, 2018 for Application No. 201680027908.9. 12 pgs.
Colombian Office Action dated Nov. 21, 2017 for Application No. NC2017/0011603, 3 pgs.
European Communication dated Jan. 5, 2018 for Application No. 16730556.4, 3 pgs.
European Communication dated Nov. 13, 2018 for Application No. 16730556.4, 4 pgs.

(Continued)

*Primary Examiner* — Nicholas A Wang
(74) *Attorney, Agent, or Firm* — Frost Brown Todd LLC

(57) ABSTRACT

A high strength steel comprises up to about 0.25 wt % C, up to about 2.0 wt % Si, up to about 2.0 wt % Cr, up to 14% Mn, and less than 0.5% Ni. It preferably has an $M_s$ temperature less than 50° C. The high strength steel may have a tensile strength of at least 1000 MPa and total elongations of at least about 25% after hot rolling. It may have a tensile strength of at least 1200 MPa and total elongations of at least about 20% after hot rolling.

16 Claims, No Drawings

(56) References Cited

FOREIGN PATENT DOCUMENTS

| | | | | |
|---|---|---|---|---|
| KR | 10-2013-0050138 | | 4/2014 | |
| RU | 2194776 | C2 | 12/2002 | |
| RU | 2312162 | C2 | 12/2007 | |
| RU | 2312920 | C2 | 12/2007 | |
| TW | 201313913 | A1 | 4/2014 | |
| UA | 29209 | A | 10/2000 | |
| WO | WO-2009090231 | A1 * | 7/2009 | ..... C22C 38/06 |

OTHER PUBLICATIONS

Russian Office Action dated Oct. 22, 2018 for Application No. 2017141033, 10 pgs.
Ukrainian Office Action dated Jan. 17, 2019 for Application No. a201711079, 3 pgs.
Canadian Office Action dated Jan. 21, 2019 for Application No. CA 2,985,544, 4 pgs.
Korean Office Action, Notification of Reason for Refusal, dated Feb. 18, 2019 for Application No. KR 10-2017-7036208, 4 pgs.

* cited by examiner

HIGH MANGANESE 3rd GENERATION ADVANCED HIGH STRENGTH STEELS

PRIORITY

This application claims priority from U.S. Provisional Application Ser. No. 62/164,643, entitled HIGH MN AUSTENITIC 3RD GENERATION ADVANCED HIGH STRENGTH STEELS, filed on May 21, 2015, the disclosure of which is incorporated by reference herein.

BACKGROUND

The automotive industry continually seeks more cost-effective steels that are lighter for more fuel efficient vehicles and stronger for enhanced crash-resistance, while still being formable. The 3rd Generation of Advance High Strength Steels (AHSS) are those that present higher tensile strength and/or higher total elongations than currently available high strength steels. These properties allow the steel to be formed into complex shapes, while offering high strength. The steels in the present application provide the desired 3rd Generation Advanced High Strength Steel mechanical properties with high tensile strengths above 1000 MPa and high total elongation above 15%, and up to 50% or higher.

Austenitic steels typically have higher ultimate tensile strengths combined with high total elongations. The austenitic microstructure is ductile and has the potential to produce high total tensile elongations. The austenitic microstructure is sometimes not stable at room temperatures (or is metastable), and when the steel is subjected to plastic deformation the austenite often transforms into martensite (stress/strain induced martensite). Martensite is a microstructure with higher strengths, and the combined effect of having a mixture of microstructures, such as austenite plus martensite, is to increase of the overall tensile strength. The stability of austenite, or in other words, the likelihood that austenite will transform into martensite during plastic deformation depends in large part on its alloy content. Elements such as C, Mn, Cr, Cu, Ni, N, and Co, among others, are used to stabilize austenite thermodynamically. Other elements, such as Cr, Mo, and Si can also be used to increase austenite stability through indirect effects (such as kinetic effects).

SUMMARY

A high strength steel comprises up to about 0.25 wt % C, up to about 2.0 wt % Si, up to about 2.0 wt % Cr, up to 14 wt % Mn, and less than 0.5 wt % Ni. The high strength steel can further comprise one or more of Mo and Cu. In some embodiments it has an $M_s$ temperature less than 50° C. The high strength steel may have a tensile strength of at least 1000 MPa and total elongations of at least about 25% after hot rolling. It may have a tensile strength of at least 1200 MPa and total elongations of at least about 20% after hot rolling.

DETAILED DESCRIPTION

The present steels substantially comprise austenitic microstructure at room temperature. The austenite will transform to martensite when plastically deformed at a rate that also results in high elongation, or ductility. The main alloying elements to control this transformation are C and Mn, Cr, and Si.

The amount of C can also have an effect on the final tensile strength of the steel as the strength of martensite is directly dependent on the carbon content. To keep the strength of the steels above 1000 MPa, carbon is present in an amount up to about 0.25 wt %.

One characteristic of Si is its ability to suppress carbide formation, and it is also a solid solution strengthener. Silicon is a ferrite former; however, it is found to lower the Ms temperature, stabilizing the austenite at room temperature. Si is included in amount of up to about 2.0 wt %.

Another element that is a ferrite former but also stabilizes austenite by lowering the martensite transformation temperature ($M_s$) is Cr. Chromium has other steel processing beneficial characteristics such as promoting delta-ferrite during solidification, which facilitates the casting of the steel. For the present steels, the amount of Cr should be up to about 2.0 wt %.

Manganese is present up to about 14 wt %, so as to stabilize at least some austenite to room temperature.

Designing alloy chemistries such that the Ms temperature is close or below room temperature is one manner in which one can ensure that austenite will be stabilized at room temperature. The relationship of Ms and alloy contents is described in the empirical equation below:

$$M_s=607.8-363.2*[C]-26.7*[Mn]-18.1*[Cr]-38.6*[Si]-962.6*([C]-0.188)^2 \quad \text{(Eqn. 1)}$$

Other elements that are thought to help stabilizing austenite can be added to these alloys such as Mo, Cu, and Ni. If Ni is added, it is added in an amount less than 0.5 wt %. If Mo is added, it is added in an amount less than 0.5 wt %. In some of the alloys Al was added as it is known to help promote delta-ferrite solidification which facilitates casting, and also increases the $A_{e1}$ and $A_{e3}$ transformation temperatures. In other embodiments, Al can be added in an amount of up to about 2.0 wt %. In other embodiments, Al can be added in an amount of up to about 3.25 wt %. In some embodiments, Al can be added in an amount of about 1.75-3.25 wt %.

EXAMPLE 1

The present alloys were processed as follows. The alloys were melted and cast using typical laboratory methods. The steel compositions of the alloys are presented in Table 1. The ingots were reheated to a temperature of 1250° C. before hot rolling. The ingots were hot rolled to a thickness of about 3.3 mm in 8 passes, with a finishing temperature of 900° C. The hot bands were immediately placed in a furnace at 650° C. and allowed to cool to room temperature in 24 hours to simulate coiling temperature and hot band coil cooling.

TABLE 1

Steels melt analysis.

| Alloy | C | Si | Mn | Cr | Cu | Ni | Al | Mo | Calculated $M_s$ [° C.] |
|---|---|---|---|---|---|---|---|---|---|
| 51 | 0.23 | 1.89 | 13.75 | 1.96 | <0.003 | <0.003 | 0.004 | <0.003 | 48 |
| 52 | 0.22 | 1.94 | 11.58 | 1.95 | <0.003 | <0.003 | 0.004 | <0.003 | 108 |
| 53 | 0.22 | 1.97 | 9.60 | 1.96 | <0.003 | <0.003 | 0.005 | <0.003 | 160 |
| 54 | 0.23 | 1.93 | 13.83 | 0.003 | 0.003 | <0.003 | 0.003 | <0.003 | 79 |
| 56 | 0.23 | 1.93 | 13.72 | 1.98 | 0.003 | <0.003 | 1.90 | <0.003 | 47 |
| 57 | 0.24 | 1.94 | 9.86 | 1.96 | <0.003 | <0.003 | 1.87 | <0.003 | 145 |
| 58 | 0.24 | 1.95 | 9.87 | 1.95 | <0.003 | <0.003 | 2.82 | <0.003 | 145 |
| 59 | 0.23 | 2.03 | 13.74 | 1.95 | <0.003 | <0.003 | 0.004 | 0.23 | 43 |

Mechanical tensile properties were tested in the transverse direction of the hot bands; the properties are presented in Table 2. Some of these hot bands showed 3rd Generation AHSS tensile properties such as alloys 54, 56, and 59, which exhibited tensile strengths above 1000 MPa and total elongations about 25%.

For all tables, YS=Yield Strength; YPE=Yield Point Elongation; UTS=Ultimate Tensile Strength. When YPE is present the YS value reported is the Upper Yield Point, otherwise 0.2% offset yield strength is reported when continuous yielding occurred.

TABLE 2

Mechanical tensile properties of the hot bands.

| | | | | | | 50.8 mm gauge length | | |
|---|---|---|---|---|---|---|---|---|
| ID | Thickness mm | Width mm | 0.5% Y.S. MPa | 0.2% off set Yield MPa | UTS MPa | Elongation Measured % | Elongation Extensometer % | Uniform Elongation % |
| 51 | | | | | | | | |
| 52 | 3.19 | 9.58 | 287 | 254 | 1308 | 15.4 | 13.8 | 13.9 |
| 53 | 3.20 | 9.45 | 0 | 285 | 1059 | 6.1 | 4.3 | 4.4 |
| 54 | 3.35 | 9.63 | 319 | 299 | 1357 | 26.1 | 23.0 | 22.7 |
| 56 | 3.38 | 9.42 | 497 | 487 | 1107 | 51.1 | 46.2 | 42.4 |
| 57 | 3.36 | 9.60 | 420 | 414 | 876 | 7.1 | 6.4 | 6.4 |
| 58 | 3.30 | 9.53 | 561 | 561 | 815 | 7.3 | 6.6 | 6.4 |
| 59 | 3.32 | 9.47 | 307 | 275 | 1456 | 35.9 | 31.2 | 30.6 |

After cooling, the hot bands were bead-blasted and pickled to remove scale. Hot band strips were then heat treated to an austenitizing temperature of 900° C., by soaking them in a tube furnace with controlled atmosphere, except alloy 58 which was annealed at 1100° C. Tensile specimens were fabricated from the annealed strips, and the mechanical tensile properties were evaluated. The tensile properties of the annealed hot bands are presented in Table 3. The alloys with higher Mn and $M_s$ temperature closer to room temperature showed extraordinary properties with high tensile strengths and high total elongation values, such as alloys 51, 56, and 59.

TABLE 3

Tensile properties of the annealed hot bands.

| | | | | | | 50.8 mm gauge length | | |
|---|---|---|---|---|---|---|---|---|
| ID | Thickness mm | Width mm | 0.5% Y.S. MPa | 0.2% off set Yield MPa | UTS MPa | Elongation Measured % | Elongation Extensometer % | Uniform Elongation % |
| 51 | 2.79 | 12.76 | 337 | 326 | 1391 | 29.6 | 30.9 | 30.1 |
| 52 | 2.80 | 12.77 | 238 | 199 | 1283 | 12.4 | 12.5 | 12.6 |
| 53 | 3.12 | 12.85 | 272 | 188 | 989 | 2.8 | 2.8 | 2.8 |
| 54 | 2.79 | 12.85 | 320 | 300 | 1193 | 18.0 | 19.6 | 19.6 |
| 56 | 3.27 | 12.75 | 454 | 454 | 1163 | 49.7 | 44.4 | 42.8 |
| 57 | 3.23 | 12.81 | 264 | 258 | 1039 | 8.3 | 7.4 | 7.4 |
| 58 | 3.21 | 12.81 | 278 | 261 | 1034 | 12.0 | 12.7 | 12.7 |
| 59 | 2.78 | 12.86 | 357 | 357 | 1473 | 38.0 | 39.1 | 38.5 |

The pickled hot bands strips of the alloys that contained close to 14 wt % Mn (alloys 51, 54, 56, and 59), were then cold reduced about 50%, to a final thickness of around 1.5 mm. The cold reduced strips were heat treated at an austenitizing temperature of 900° C., by soaking them in a tube furnace with controlled atmosphere. Tensile specimens were fabricated from the annealed strips, and the mechanical tensile properties were evaluated, and are presented Table 4.

TABLE 4

Tensile properties of heat treated samples.

| | | | | | | 50.8 mm gauge length | | |
|---|---|---|---|---|---|---|---|---|
| Alloy | Thickness mm | Width mm | 0.5% Y.S. MPa | 0.2% off set Yield MPa | UTS MPa | Elongation Measured % | Elongation Extensometer % | Uniform Elongation % |
| 51 | 1.42 | 12.77 | 375 | 359 | 1207 | 23.1 | 22.2 | 21.6 |
| 54 | 1.45 | 12.80 | 345 | 323 | 716 | 7.6 | 7.8 | 7.8 |
| 56 | 1.68 | 12.77 | 414 | 407 | 1220 | 51.8 | 52.5 | 51.9 |
| 59 | 1.44 | 12.80 | 381 | 371 | 878 | 12.7 | 13.2 | 13.3 |

The heat treated samples showed 3rd Generation AHSS tensile properties, such as alloys 51 and 56, which exhibited a UTS of 1220 MPa and a total elongation of 51.8%.

What is claimed is:

1. A high strength steel comprising up to 0.25 wt % C, up to 2.0 wt % Si, up to 2.0 wt % Cr, greater than 10% and up to 14% Mn, less than 0.5% Ni; and no intentional addition of Cu, the balance Fe and inevitable impurities, wherein the high strength steel has a $M_s$ temperature of less than 50° C. when $M_s$ is calculated in degrees Celsius according to the following equation:

$$M_s=607.8-363.2*[C]-26.7*[Mn]-18.1*[Cr]-38.6*[Si]-962.6*([C]-0.188)^2.$$

2. The high strength steel of claim 1, further comprising up to about 3.25 wt % Al.

3. The high strength steel of claim 2, comprising up to about 2.0 wt % Al.

4. The high strength steel of claim 1, comprising 1.75-3.25 wt % Al.

5. The high strength steel of claim 1, further comprising up to about 0.5 wt % Mo.

6. The high strength steel of claim 1, wherein the steel has a tensile strength of at least 1000 MPa and total elongations of at least about 25% after hot rolling.

7. The high strength steel of claim 1, wherein the steel has a tensile strength of at least 1200 MPa and total elongations of at least about 20% after hot rolling.

8. The high strength steel of claim 1, wherein the steel has a tensile strength of at least 1000 MPa and total elongations of at least about 25% after hot rolling and annealing.

9. The high strength steel of claim 1, wherein the steel has a tensile strength of at least 1200 MPa and total elongations of at least about 20% after hot rolling and annealing.

10. The high strength steel of claim 1, wherein the steel has a tensile strength of at least 1000 MPa and total elongations of at least about 25% after cold rolling and annealing.

11. The high strength steel of claim 1, wherein the steel has a tensile strength of at least 1200 MPa and total elongations of at least about 20% after cold rolling and annealing.

12. A high strength steel comprising 0.05 to 0.25 wt % C, greater than 10% and up to 14 wt % Mn, 1.0 to 2.0 wt % Si, 1.75 to 3.75 wt % Al, 0.00 to 2.0 wt % Cr, 0.0 to 0.5 wt % Ni, 0.0 to 0.5 wt % Mo, no intentional addition of Cu, the balance Fe and inevitable impurities, wherein the high strength steel has a $M_s$ temperature of less than 50° C. when $M_s$ is calculated in degrees Celsius according to the following equation:

$$M_s=607.8-363.2*[C]-26.7*[Mn]-18.1*[Cr]-38.6*[Si]-962.6*([C]-0.188)^2.$$

13. The high strength steel of claim 12, wherein the steel has a tensile strength of at least 1000 MPa and total elongations of at least about 25% after hot rolling.

14. The high strength steel of claim 12, wherein the steel has a tensile strength of at least 1200 MPa and total elongations of at least about 20% after hot rolling.

15. The high strength steel of claim 12, wherein the steel has a tensile strength of at least 1000 MPa and total elongations of at least about 25% after hot rolling and annealing.

16. The high strength steel of claim 12, wherein the steel has a tensile strength of at least 1200 MPa and total elongations of at least about 20% after hot rolling and annealing.

* * * * *